United States Patent [19]

Nordvall

[11] 4,332,154

[45] Jun. 1, 1982

[54] DEFLECTOR ROLL

[75] Inventor: Jan O. Nordvall, Västerås, Sweden

[73] Assignee: ASEA Aktiebolag, Västerås, Sweden

[21] Appl. No.: 116,998

[22] Filed: Jan. 30, 1980

[30] Foreign Application Priority Data

Feb. 1, 1980 [SE] Sweden ..... 7900869

[51] Int. Cl.[3] ..... B21C 51/00; B21B 37/04; B21B 37/06

[52] U.S. Cl. ..... 72/31; 72/17; 73/862.07; 226/196

[58] Field of Search ..... 72/17, 35, 8–12, 72/34, 31; 73/159, 862.07; 226/44, 45, 190, 194, 196

[56] References Cited

U.S. PATENT DOCUMENTS

| | | | |
|---|---|---|---|
| 3,581,536 | 6/1971 | Terwilliger | 72/17 X |
| 3,817,095 | 6/1974 | Drolot | 72/17 X |
| 4,116,029 | 9/1978 | Fabian et al. | 72/34 |

*Primary Examiner*—Francis S. Husar
*Assistant Examiner*—Jonathan L. Scherer
*Attorney, Agent, or Firm*—Watson, Cole, Grindle & Watson

[57] ABSTRACT

A deflector roll for a strip mill is divided axially into sections to be able to measure the distribution of the strip tension across the strip width. To avoid transmitting the measuring signals from movable parts, the sections of the deflector roll are supported by rollers journalled in stationary holders, the force-measuring transducers being built into the holders.

2 Claims, 4 Drawing Figures

FIG. 1
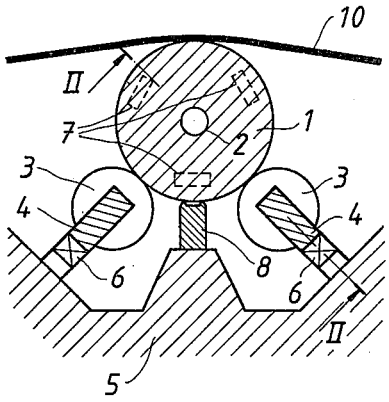
FIG. 2
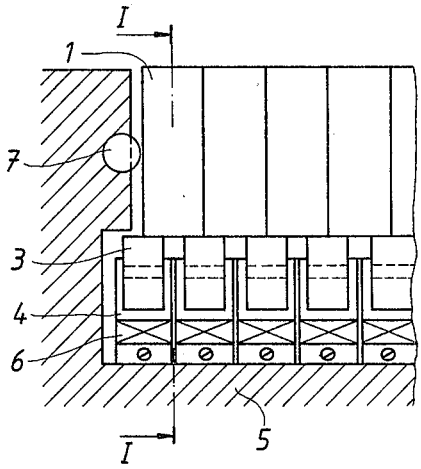
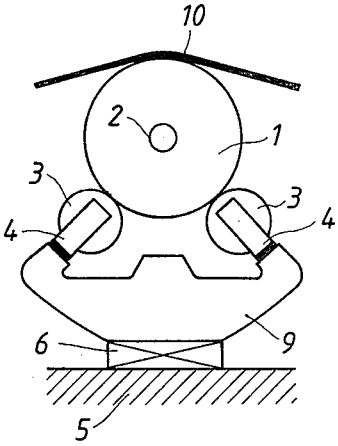
FIG. 3
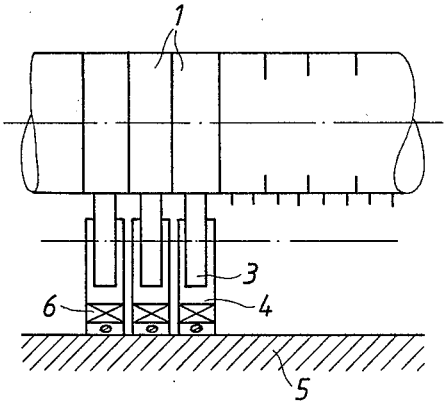
FIG. 4

DEFLECTOR ROLL

TECHNICAL FIELD

The present invention relates to a deflector roll in a strip mill for measuring the distribution of the strip tension over the strip width, which deflector roll is arranged in a number of sections arranged axially one adjacent to another.

DISCUSSION OF PRIOR ART

A deflector roll of the above-mentioned kind may, for example, be used for measuring the distribution of the strip tension over the strip width. In a hitherto known design of such a deflector roll, the noted sections have been equipped with force-measuring transducers. This design, however, gives rise to the problem of transmitting the output signals from the transducers in the rotating sections to stationary measuring equipment and furthermore can result in the transducers being subjected to unacceptably high working temperatures. It is also known to support the deflector roll by two rollers, but the measuring transducers were still located in a moving part of the system.

The present invention aims to provide a solution to the above-mentioned problems and problems associated therewith.

SUMMARY OF INVENTION

According to the present invention, there is provided a deflector roll in a strip mill for measuring the distribution of tension across the width of a strip contacting the roll, the deflector roll being divided into a plurality of sections arranged axially one adjacent to another, these sections being supported against the force imparted to the sections of the deflector roll by the strip by supporting rollers, each arranged on one side of the deflector roll, which is characterised in that the supporting rollers are journalled in holders which include force-measuring transducers.

With a deflector roll according to the invention, it is possible to thermally insulate the force-measuring transducers from the sections of the roll, thus making it possible to use the roll for measurements on hot strip. Transmitting the output signals from the force-measuring transducers to the measuring equipment will also become easier since the force-measuring transducers are located in the stationary part of the deflector roll system. The different location of the force-measuring transducers outside of a deflector roll according to the invention makes maintenance of the system easier, and the thermal stresses on the transducers will not be as great.

BRIEF DESCRIPTION OF THE DRAWING

The invention will now be described in greater detail, with reference to the accompanying drawing, in which:

FIG. 1 shows a section through a deflector roll in accordance with the invention taken on the line I—I of FIG. 2, FIG. 2 is a sectional view of one end of the deflector roll taken on the line II—II of FIG. 1, FIG. 3 shows a different design for a holder for the supporting rollers, and FIG. 4 shows an alternative location for the holders and their supporting rollers.

DESCRIPTION OF SPECIFIC EMBODIMENTS ILLUSTRATED

FIGS. 1 and 2 show a first embodiment of a deflector roll for measuring the tension of a strip 10 shown in FIG. 1. The deflector roll is divided, in the longitudinal direction, into sections 1 mounted on a common shaft 2. The shaft 2, is, however, relatively weak and is designed only to hold the sections 1 together. The sections 1 are supported by pairs of supporting rollers 3 arranged in fixed holders 4 on a foundation 5. The rollers 3 may, for example, be supported by ball or roller bearings. To hold the sections 1 together in the axial direction of the shaft 2, end rollers 7 are further provided in the foundation 5 at opposite ends of the deflector roll. Since the sections 1 of the deflector roll are supported on two parallel rows of rollers 3, the force exerted on the deflector roll by the strip 10 can be measured in two directions, with the advantage that the angle through which the strip 10 is deflected on its passage over the deflector roll may be allowed to vary within wide limits. Therefore, no special auxiliary deflector rolls are required to control the angle of strip deflection at the deflector roll.

The holders 4 contain built-in force transducers 6 for measuring the compressive forces exerted by the strip 10 on the individual sections. These transducers 6 can be of a known kind, for example, magnetostrictive transducers. Since they are located in stationary holders 4, it will be easy to arrange signal connections therefrom. Further, it is easy to protect the transducers 6 both from mechanical abuse and from the heat of the strip, and therefore the design of deflector roll shown in FIG. 1 may be used in hot rolling mills as well as cold rolling mills.

To ensure a correct positioning of the sections 1 and the rollers 3 during assembly of the deflector roll, the sections 1 are located on a ruler 8 during assembly (as shown in FIG. 1). Thereafter, the holders 4 are aligned so that the respective rollers 3 are each brought into precise contact with the respective sections 1. After correct assembly, the ruler 8 is removed.

FIG. 3 shows a somewhat different arrangement of the holders 4 for the supporting rollers 3. In this embodiment, each pair of holders 4 is supported from a common foot 9 on the foundation 5, so that only one transducer 6 is required for each pair of rollers 3.

As shown in FIG. 2, each roller 3 (except those of the first and last pairs) is located to span across the joint between two adjacent sections 1. In the arrangement shown in FIG. 4, on the other hand, each section 1 rests solely on one pair of rollers 3. With this arrangement, therefore, the output of each transducer 6 will relate to the force on one section 1 only, whereas with the arrangement shown in FIG. 2, each transducer 6 refers to two adjacently positioned sections 1. On the other hand, the embodiment according to FIG. 2 normally gives a somewhat better support for the individual sections 1 of the deflector roll, which reduces the risk of indentations being formed in the strip 10 by the deflector roll due to level differences arising between the sections 1.

What is claimed is:

1. A deflector roll assembly for measuring the distribution of tension across the width of a strip passing through a strip mill, the assembly including a deflector roll over which said strip passes, said deflector roll being formed by a plurality of roll sections rotatably mounted about a relatively weak central shaft and axially positioned in abutting side-by-side relationship, a foundation means, and a multiplicity of support means, two of said support means being associated with each roll section and each of said support means, except the two axially outermost ones, supporting two of the abutting roll sections, each support means including two supporting rollers positioned on opposite lower sides of the roll sections to be supported and separate holders stationarily attached to the foundation means to rotatably mount the associated supporting roller, each holder including a magnetostrictive transducer for measuring the forces applied to the respective holder through the respective support roller.

2. A deflector roll assembly according to claim 1 wherein end rollers are rotatably mounted in said foundation means to bear against the outermost axial roll sections to hold them in position along the length of the relatively weak central shaft.

* * * * *

UNITED STATES PATENT OFFICE
CERTIFICATE OF CORRECTION

PATENT NO. : 4,332,154
DATED : June 1, 1982
INVENTOR(S) : Jan Nordvall

It is certified that error appears in the above-identified patent and that said Letters Patent are hereby corrected as shown below:

On the title page:

[30] FOREIGN APPLICATION PRIORITY DATA

February 1, 1979 [SE] Sweden.....7900869

Signed and Sealed this

*Nineteenth* Day of *October 1982*

[SEAL]

*Attest:*

GERALD J. MOSSINGHOFF

*Attesting Officer* *Commissioner of Patents and Trademarks*